US008312854B2

(12) United States Patent
Weinrotter et al.

(10) Patent No.: US 8,312,854 B2
(45) Date of Patent: Nov. 20, 2012

(54) IGNITION DEVICE FOR A LASER IGNITION SYSTEM OF AN INTERNAL COMBUSTION ENGINE

(75) Inventors: Martin Weinrotter, Stuttgart-Botnang (DE); Pascal Woerner, Stuttgart (DE); Juergen Raimann, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 216 days.

(21) Appl. No.: 12/675,509

(22) PCT Filed: Jul. 11, 2008

(86) PCT No.: PCT/EP2008/059080

§ 371 (c)(1),
(2), (4) Date: Jul. 7, 2010

(87) PCT Pub. No.: WO2009/027145

PCT Pub. Date: Mar. 5, 2009

(65) Prior Publication Data

US 2010/0263615 A1 Oct. 21, 2010

(30) Foreign Application Priority Data

Aug. 31, 2007 (DE) ..... 10 2007 041 528

(51) Int. Cl.
*F02B 19/12* (2006.01)
*F02B 19/00* (2006.01)

(52) U.S. Cl. ..... 123/143 B

(58) Field of Classification Search ..... 123/143 B, 123/143 R, 143 C, DIG. 9; 431/254; 372/23, 372/25, 71
See application file for complete search history.

(56) References Cited

U.S. PATENT DOCUMENTS

| | | | | |
|---|---|---|---|---|
| 7,036,476 | B2 * | 5/2006 | Wintner et al. | 123/143 B |
| 2006/0132930 | A1 | 6/2006 | Kopecek et al. | |
| 2008/0035088 | A1 * | 2/2008 | Klausner et al. | 123/143 B |
| 2010/0000485 | A1 | 1/2010 | Vogel et al. | |
| 2010/0000486 | A1 * | 1/2010 | Herden et al. | 123/143 B |

FOREIGN PATENT DOCUMENTS

| | | |
|---|---|---|
| DE | 102006024679 | 11/2007 |
| EP | 1674721 | 6/2006 |
| EP | 1820948 | 8/2007 |
| JP | 55-88074 | 6/1980 |
| JP | 8-93542 | 4/1996 |
| JP | 2007-231943 | 9/2007 |
| WO | WO 2005/021959 | 3/2005 |
| WO | WO 2005/066488 | 7/2005 |
| WO | WO 2005/093309 | 10/2005 |
| WO | WO 2006/125685 | 11/2006 |

OTHER PUBLICATIONS

International Search Report, PCT International Patent Application No. PCT/EP2008/059080, dated Nov. 26, 2008.

* cited by examiner

*Primary Examiner* — Mahmoud Gimie
(74) *Attorney, Agent, or Firm* — Kenyon & Kenyon LLP

(57) ABSTRACT

An ignition laser for an internal combustion engine is provided, wherein the combustion chamber window is connected to a housing of the ignition laser in a gas-, pressure-, and temperature-resistant manner.

20 Claims, 6 Drawing Sheets

IGNITION DEVICE FOR A LASER IGNITION SYSTEM OF AN INTERNAL COMBUSTION ENGINE

BACKGROUND INFORMATION

A so-called laser ignition system is described in PCT Application WO 2005/066488 A1. This laser ignition system includes an ignition laser which projects into the combustion chamber of an internal combustion engine. The ignition laser is optically pumped from a pumped light source using an optical fiber.

At one end of the ignition laser facing the combustion chamber, a combustion chamber window is present which is transmissive for the laser beams generated in the ignition laser. This combustion chamber window is accommodated in a sealing manner in a housing of the ignition laser. Great demands are placed on the seal between the combustion chamber window and the housing due to the fact that surface temperatures of over 600° C. may occur at the combustion chamber window during operation of the internal combustion engine. In addition, there are intermittent pressure loads of greater than 250 bar. When an ignition laser is used to ignite a gas turbine, although lower pressures prevail in the combustion chamber of the gas turbine, the surface of the combustion chamber window may reach temperatures of up to 1000° C.; in any case, uncontrolled auto-ignition must be prevented.

The interior of the ignition laser should be securely sealed from the extremely high temperatures and pressures. If the exhaust gases should enter the interior of the ignition laser, this would result in failure of the ignition laser.

SUMMARY

An object of the present invention is to provide an ignition laser in which the combustion chamber window and the housing are sealed in such a way that secure and reliable sealing of the combustion chamber window and housing is ensured over the entire service life of the internal combustion engine and at the pressures and temperatures which prevail in the combustion chamber of an internal combustion engine.

For an ignition laser for an internal combustion engine, including a laser-active solid, a combustion chamber window, and a housing, this object may be achieved according to an example embodiment of the present invention by providing the housing and the combustion chamber window at least indirectly integrally connected to one another.

As a result of the integral connection of the housing and the combustion chamber window according to the example embodiment of the present invention, the required seal-tightness is ensured even at extremely high pressures and temperatures. The portion of the housing which is integrally connected to the combustion chamber window has a coefficient of thermal expansion which is as similar as possible to that of the combustion chamber window. In this manner the thermal stresses are reduced, and as a result the service life and reliability of the integral connection between the housing and the combustion chamber window are increased.

Alternatively, it is possible to press the housing and the combustion chamber window together in a pressing manner. Of course, sufficient contact force between the housing and the combustion chamber should be ensured for all operating conditions. To increase the contact pressure, it is recommended that the sealing surface between the combustion chamber window and the housing be made as small as possible.

To be able to meet the conflicting requirements for the housing with regard to heat resistance, pressure resistance, and coefficient of thermal expansion, in a further advantageous embodiment of the present invention it is provided that the housing and the combustion chamber window are indirectly integrally connected to one another using a diaphragm or a spacer ring.

It is thus possible to optimize the housing in particular with regard to heat resistance and mechanical load-bearing capacity, and by the choice of a suitable integral for the diaphragm or spacer ring, to optimize the integral connection to the combustion chamber window with regard to its seal-tightness and service life. This is particularly advantageous for the first joint between the diaphragm or spacer ring on the one hand and the combustion chamber window, for which in this case a tight connection must be achieved between glass and metal. The connection between the housing on the one hand and the diaphragm or spacer ring on the other hand is not problematic from a production standpoint, since this is generally a metal-metal connection which may be established, for example, using soldering, welding, or other well-known and proven joining techniques.

As the result of inserting a diaphragm or spacer ring in between, a "stepped" transition is also achieved between the differing material properties of the combustion chamber window, which may be made of quartz glass or sapphire glass, and the housing, which may be made of a heat-resistant metallic material.

As the result of separating the housing into an inner shell and an outer shell, it is also possible to achieve a design of the outer shell and inner shell which in each case is optimally adapted to the particular task. By the selection of various materials for the outer shell and inner shell it is also possible to provide a further optimized ignition laser.

Alternatively, it is possible to integrally connect the diaphragm to the outer shell and the combustion chamber window, or to the inner shell and the combustion chamber window.

For the inner shell, diaphragm, and/or spacer ring it is recommended that materials be used whose coefficients of thermal expansion essentially correspond to that of the combustion chamber window. The material Pernifer 2198 MS from Thyssen VDM, for example, is particularly suitable for this purpose.

Alternatively, the inner shell, diaphragm, and/or spacer ring may be made of a ductile material, preferably nickel or copper. In this manner, any thermal stresses which occur in the joint between the housing and the combustion chamber window are eliminated due to the ductility of the material, and the joint is thus mechanically relieved. Of course, it is particularly advantageous to use a material whose coefficient of thermal expansion is similar to that of the combustion chamber window and which at the same time is ductile. In this manner the advantages of the two specific embodiments have an additive effect.

Alternatively, the same effect may be achieved by a combination of an inner shell, a diaphragm, and/or spacer ring made of a ductile material with an inner shell, a diaphragm, and/or spacer ring made of a material whose coefficient of thermal expansion is similar to that of the combustion chamber window.

A heat-resistant material, preferably type 1.4913 steel, has proven to be suitable for the outer shell.

The integral connection between the housing, diaphragm, spacer ring, and combustion chamber window may be achieved by hard soldering, soft soldering, welding, gluing, in particular using ceramic and/or metallic adhesives, or vitrification.

For soldering, in order to achieve a good connection between the solder and the combustion chamber window, the surface of the combustion chamber window is wetted. This may be carried out by metal coating, for example using the so-called W/Mn process, the Mo/Mn process, vapor deposition by chemical vapor deposition (CVD) or physical vapor deposition (PVD), ion plating, and/or active soldering. For active soldering the solder contains at least one surface-active element such as titanium, for example.

It is also possible to use a glass solder, which advantageously has a silver-glass composition. Such glass solders are offered and sold by the companies Schott and Ferro, for example. In these compositions silver, among other functions, acts as a ductile material, so that is also possible to join materials together which have different coefficients of thermal expansion.

For soldering, solders are used which have a comparatively low soldering temperature in order to reduce the heat stresses which arise during cooling. Of course, the solder should be resistant to the temperatures which occur during operation.

To reduce the thermal load on the joint, the joint is preferably situated between the housing and the combustion chamber window on the side of the combustion chamber window facing away from the combustion chamber of the internal combustion engine. Alternatively, a joint may be provided on each side of the combustion chamber window. This results in redundancy of the seal, and therefore increased protection against loss of function of the seal.

If the combustion chamber window and the housing are to be sealed by pressing together instead of by an integral connection, it has proven advantageous to provide a coating composed of a ductile material, preferably copper, in the region of the sealing surface. If this coating is composed of copper, for example, due to the high surface pressure and operating temperatures between the combustion chamber window and the housing, the copper becomes ductile in the region of the sealing surface and therefore fills the rough areas of the combustion chamber window and the housing in the region of the sealing surface. This ensures a long-lasting and reliable seal.

This coating may be between 5 μm and 100 μm thick, and is preferably applied by electroplating.

To apply the necessary pressing force, it is advantageous for the outer shell to have a projection at its end facing the combustion chamber, this projection partially covering the combustion chamber window. By use of a screw connection between the outer shell and inner shell these shells may be braced against one another in the axial direction, thus generating the necessary sealing force. Alternatively, the outer shell and inner shell may be integrally connected to one another in the pretensioned state.

The pretensioning force of the screw connection may be influenced over a wide range by the design of the outer shell and inner shell. For this purpose the methods of the (expansion) screw calculation may be used. Thus, for example, the outer shell may have a region in which controlled expansion takes place, while the inner shell is compressed in the region between the sealing surface and the thread as a result of the pretensioning force. This results in a "softer" screw connection, which in particular has a positive effect on the sealing force, also at fluctuating temperatures.

Further advantages and advantageous embodiments of the present invention are shown in the figures described below. All of the features shown in the figures, and the description thereof, may be part of the present invention, individually or in any given combination.

DETAILED DESCRIPTION OF EXAMPLE EMBODIMENTS

Figure 1A:
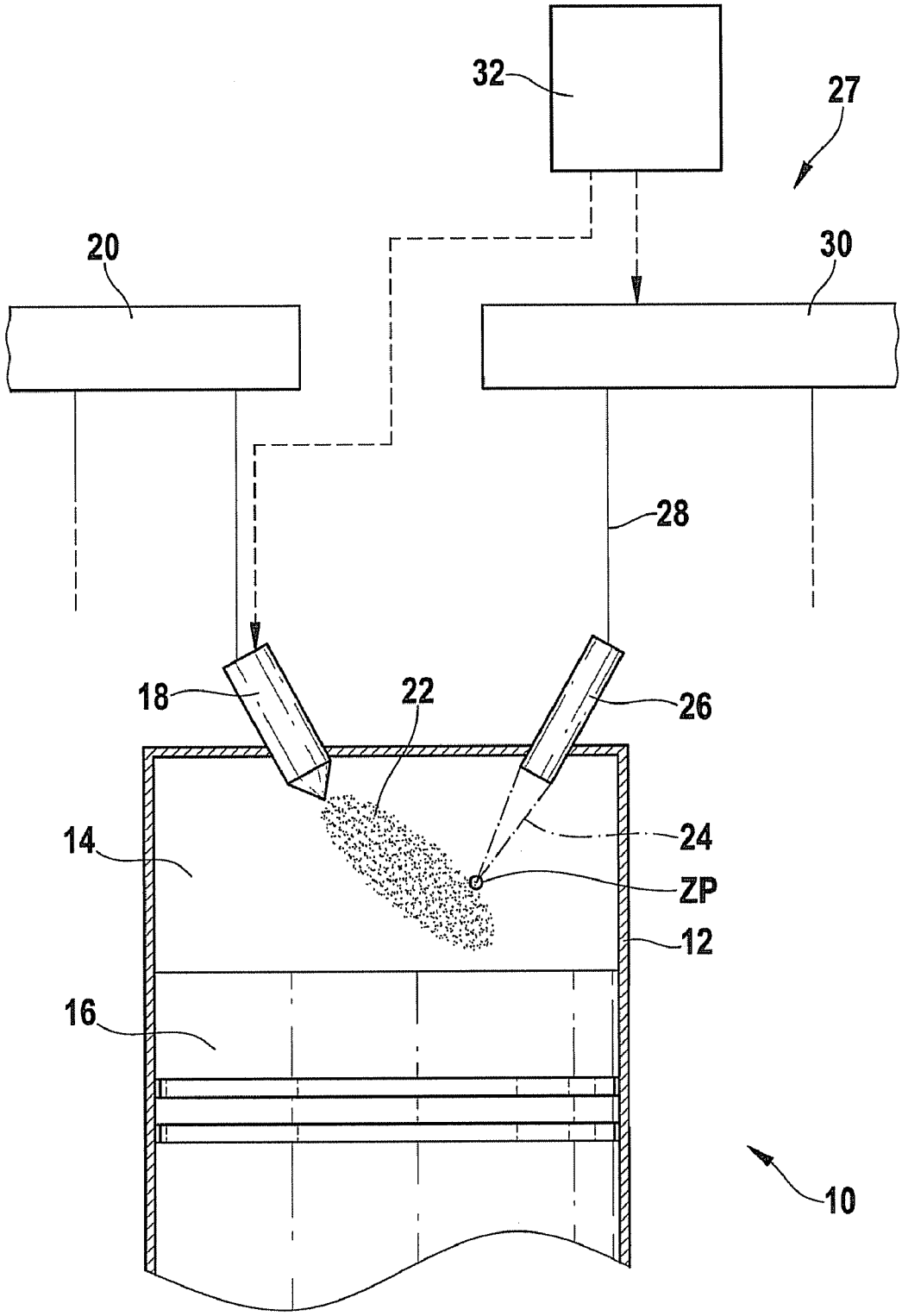
FIG. 1*a* shows a schematic illustration of an internal combustion engine having a laser-based ignition device.

An internal combustion engine is collectively denoted by reference numeral 10 in FIG. 1*a*. The internal combustion engine may be used to drive a motor vehicle. Internal combustion engine 10 typically includes multiple cylinders, of which only one is denoted by reference numeral 12 in FIG. 1*a*. A combustion chamber 14 for cylinder 12 is delimited by a piston 16. Fuel passes directly into combustion chamber 14 via an injector 18, which is connected to a fuel pressure accumulator 20, also referred to as a rail. Alternatively, the fuel-air mixture may be formed outside combustion chamber 14, for example in the intake manifold.

Fuel-air mixture 22 present in combustion chamber 14 is ignited using a laser pulse 24 which is emitted into combustion chamber 14 by use of an ignition device 27 which includes an ignition laser 26. For this purpose, laser unit 24 is fed via an optical fiber device 28, using a pumped light which is provided by a pumped light source 30. Pumped light source 30 is controlled by a control device 32, which also activates injector 18.

Figure 1B:
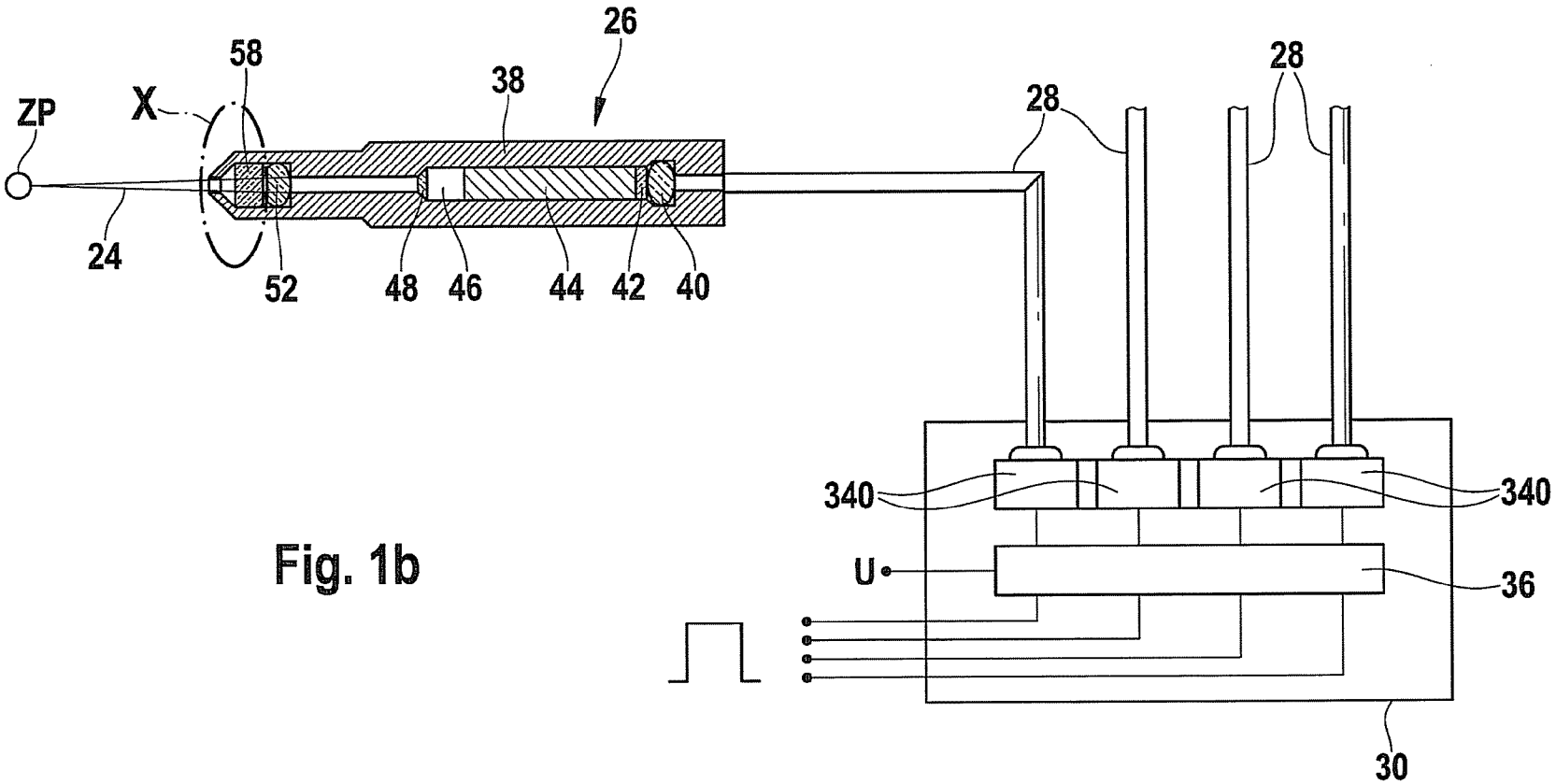
FIG. 1*b* shows a schematic illustration of the ignition device from FIG. 1.

As shown in FIG. 1*b*, pumped light source 30 feeds multiple optical fiber devices 28 for various ignition lasers 26, each of which is associated with a cylinder 12 of internal combustion engine 10. For this purpose, pumped light source 30 has multiple individual laser light sources 340 which are connected to a pulse current supply 36. Due to the presence of multiple individual laser light sources 340, in a manner of speaking a "static" distribution of pumped light to the various laser units 26 is achieved, so that an optical distributor or the like between pumped light source 30 and ignition lasers 26 is not necessary.

Ignition laser 26 has, for example, a laser-active solid 44 with a passive Q-switch 46, which together with an input mirror 42 and an output mirror 48 forms an optical resonator. Acted upon by pumped light generated by pumped light source 30, ignition laser 26 generates, in a conventional manner, a laser pulse 24 which is focused by a focusing lens 52 onto an ignition point ZP located in combustion chamber 14 (FIG. 1*a*). The components present in housing 38 of ignition laser 26 are separated from combustion chamber 14 by a combustion chamber window 58.

Figure 2:
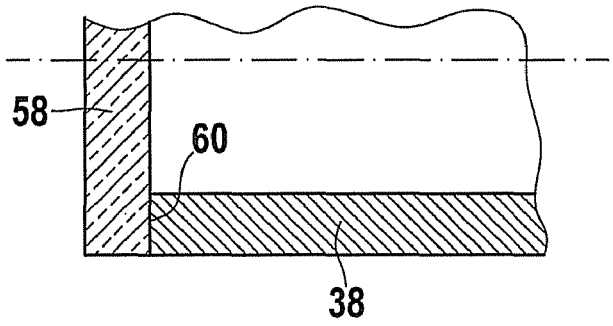
FIGS. 2 through 7 show exemplary embodiments of ignition lasers according to the present invention.

FIG. 2 illustrates detail X from FIG. 1*b* in a greatly enlarged partial longitudinal section. This greatly enlarged illustration clearly shows that combustion chamber window 58 is integrally connected to an end face of housing 38. The joint is denoted by reference numeral 60 in FIG. 2. The integral connection between combustion chamber window 58 and housing 38 may be achieved by soldering, in particular hard soldering, soft soldering, gluing, vitrification, or welding. In the exemplary embodiment illustrated in FIG. 2, housing 38 preferably has a coefficient of thermal expansion which corresponds to the coefficient of thermal expansion of combustion chamber window 58. In this manner heat stresses are avoided, and joint 60 is thus relieved. At the same time, however, housing 38 is made of a heat-resistant material, and therefore also has adequate fatigue strength under the operating temperatures which prevail in the combustion chamber. The small space requirement is particularly advantageous for this design variant.

Figure 3:
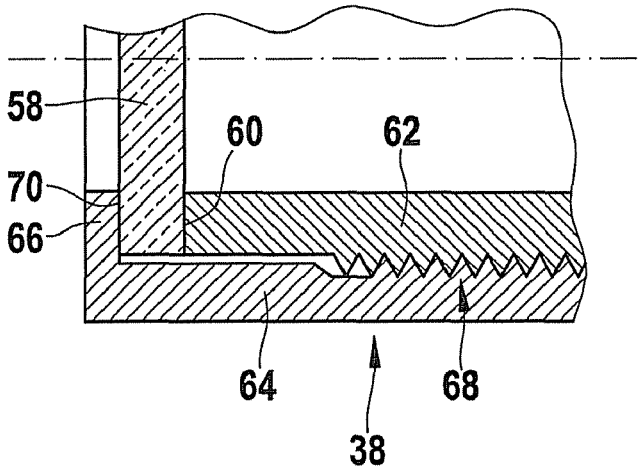

FIG. 3 illustrates a further exemplary embodiment of a connection according to the present invention between combustion chamber window 58 and housing 38, likewise in a partial longitudinal section.

In this exemplary embodiment, housing 38 has a two-part design. The housing includes an inner shell 62 and an outer shell 64. Outer shell 64 has a projection 66 at one end which faces combustion chamber 14 (see FIG. 1*a*). Projection 66 generally has two functions. First, it shields a portion of combustion chamber window 58 from the combustion chamber and the pressures and temperatures which prevail therein, thus reducing the thermal load on combustion chamber window 58.

Second, with the aid of projection 66 it is possible to press combustion chamber window 58 against inner shell 62 and thus increase the seal-tightness of joint 60. For this purpose an internal thread is provided on outer shell 64 which cooperates with a corresponding external thread of inner shell 62. This thread, composed of the internal thread and external thread, is collectively denoted by reference numeral 68. In addition, instead of the thread the inner shell may be pressed onto the outer shell with a specified contact pressure, and the connection may be established by welding or another integral connection process.

In the specific embodiments illustrated in FIGS. 2 and 3, all pressure forces are transmitted via joint 60 from combustion chamber window 58 into housing 38, or inner shell 62 of housing 38.

As the result of separating housing 38 into an inner shell 62 and an outer shell 64, the designer has more degrees of freedom for function-optimized design of the two referenced components and joint 60. Thus, for example, the material of outer shell 64 may be optimized with regard to heat resistance and fatigue strength, while the material of inner shell 62 may be selected in such a way that its coefficient of thermal expansion corresponds as closely as possible to the coefficient of thermal expansion of combustion chamber window 58. As a result, the thermal stresses are reduced and joint 60 is relieved. Of course, it is also possible to select the material of inner shell 62 in such a way that the integral connection between combustion chamber window 58 and inner shell 62 may be designed to be as secure, simple, and durable as possible.

Bracing outer shell 64 and inner shell 62 results in a sealing surface 70 between projection 66 and the combustion chamber window which thus represents a redundant seal, and which in a manner of speaking is provided upstream from joint 60 and thus either completely separates combustion chamber 14 and the interior of ignition laser 26, or at least reduces the temperature and pressure load on joint 60, as a result of which joint 60 is relieved.

To optimize the sealing effect of sealing surface 70, it may be advantageous to provide projection 66 or combustion chamber window 58, for example, with a coating composed of a ductile material, for example copper, in the region of sealing surface 70. In this manner very small uneven areas in the contact surfaces between combustion chamber window 58 and outer shell 64 are evened out and the sealing effect is improved. This coating may have a thickness of 5 μm to 100 μm, for example.

Alternatively, the positions of joint 60 and sealing surface 70 could be interchanged. This would mean that combustion chamber window 58 is integrally connected to projection 66 of outer shell 64, and combustion chamber window 58 is pressed in a sealing manner against the end face of the inner shell. However, it should be taken into account that the thermal load is higher in the region of the contact surface between projection 66 and combustion chamber window 58 than between combustion chamber window 58 and inner shell 62.

Figure 4:
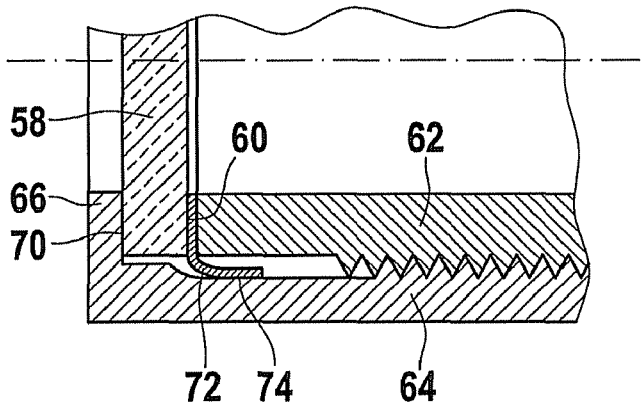

In the exemplary embodiment illustrated in FIG. 4, a diaphragm 72 is provided which at one end is integrally connected to combustion chamber window 58 in the region of joint 60. At its other end the diaphragm is integrally connected to outer shell 64. This second joint is denoted by reference numeral 74 in FIG. 4. On its side facing away from the combustion chamber window, diaphragm 72 contacts inner shell 62, and is also pressed against inner shell 62 by the pressure prevailing in combustion chamber 14 or by the bracing of inner shell 62 against outer shell 64. A gas-tight connection between diaphragm 72 and inner shell 62 is not necessary in the region of joint 60, since at its other end at second joint 64 the diaphragm is connected to outer shell 64 in a gas-tight manner.

Figure 5:
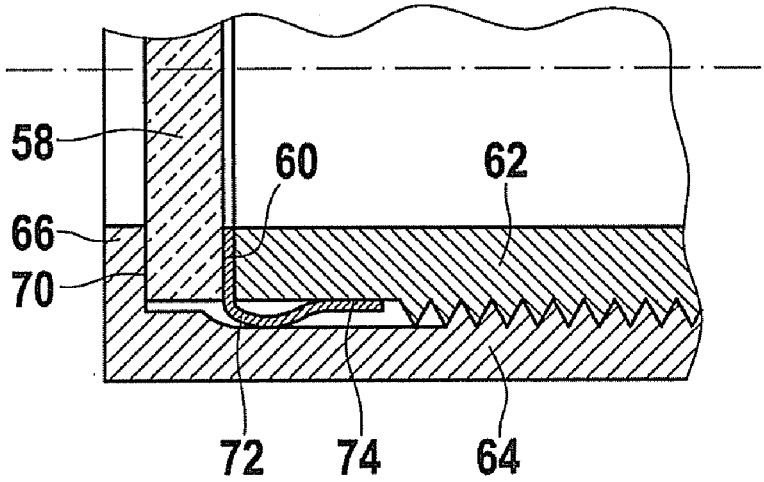

In the exemplary embodiment illustrated in FIG. 5, diaphragm 72 is connected to inner shell 62 in the region of second joint 74. Also as a result of using diaphragm 72, relative motions between combustion chamber window 58 and housing 38 may be compensated without major mechanical stresses, and with regard to the materials a degree of freedom is obtained for the selection of the materials of inner shell 62, outer shell 64, and diaphragm 72.

Figure 6:
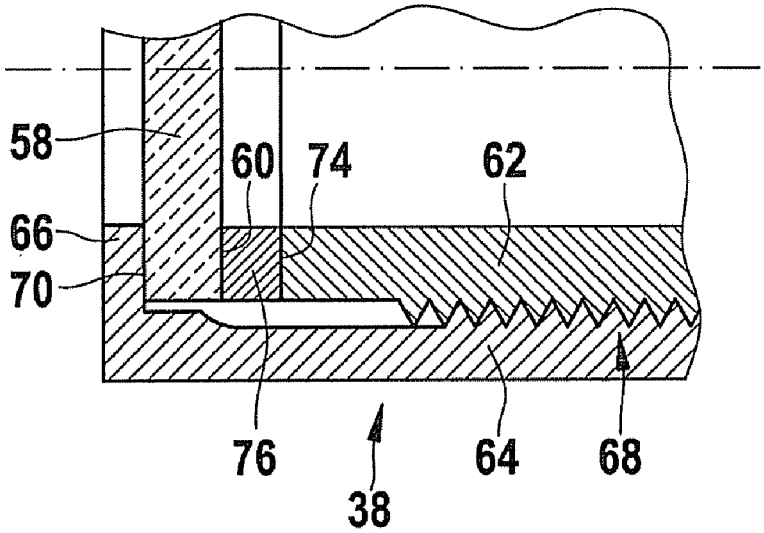

A similar effect may be achieved by inserting a spacer ring 76 between inner shell 62 and combustion chamber window 58, as illustrated in FIG. 6. This spacer ring 76 may be composed of a different material than inner shell 62, and in the region of first joint 60 is integrally connected to combustion chamber window 58 and in the region of second joint 64 is integrally connected to inner shell 62. It is not absolutely necessary to use the same joining methods for first joint 60 and second joint 64. Rather, in each case the optimal method should be used for joints 60 and 74. Spacer ring 76 may be made of a number of different materials which are firmly and tightly joined together. In this manner a stepwise or continuous adaptation of the (material) properties of combustion chamber window 58 and inner shell 62 is achieved.

In the exemplary embodiments according to FIGS. 3 through 7, in each case a sealing surface 70 and a first joint 60 are provided at the combustion chamber window 58. Alternatively, instead of sealing surface 70, it is possible to provide an integral connection between projection 66 and combustion chamber window 58.

Figure 7A:
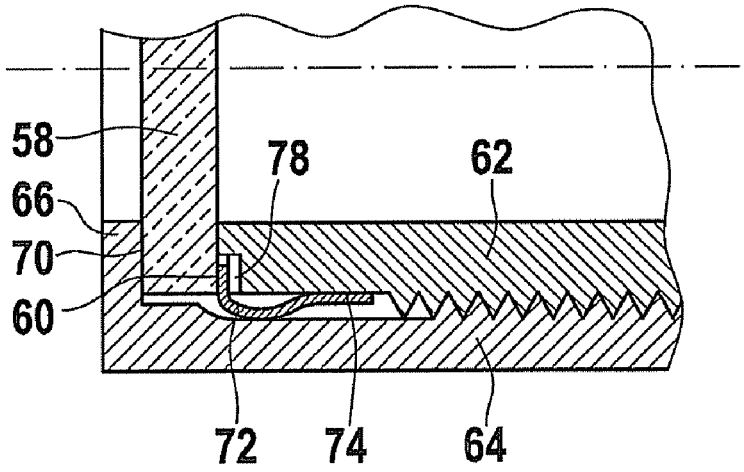

All of the exemplary embodiments according to FIGS. 2 through 6 share the common feature that the force flows from combustion chamber window 58 to housing 38 or inner shell 62 through the joint. FIG. 7 illustrates an exemplary embodiment in which first joint 60 is not used for force transmission. In this exemplary embodiment, similarly as for FIG. 5, diaphragm 72 is sealingly fastened to combustion chamber window 58 in the region of first joint 60, and on the other hand it is integrally connected to inner shell 62 in the region of second joint 74. To relieve pressure on first joint 60, a recess 78 is present at the end face of inner surface 62 which ensures that in the region of first joint 60, diaphragm 72 is not used for force transmission between combustion chamber window 58 and inner shell 62.

Figure 7B:
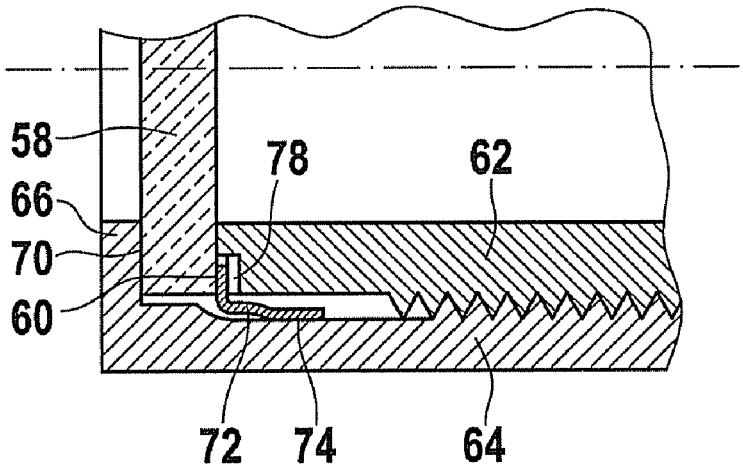
Figure 7C:
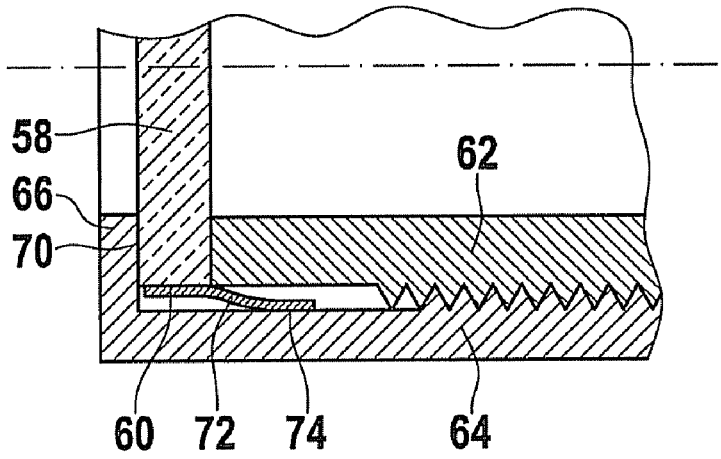

Similarly as for the exemplary embodiments according to FIGS. 4 and 5, the diaphragm may also be sealingly connected to outer shell 64, as illustrated in FIG. 7*b*. The joint may also be provided on the outer diameter of combustion chamber window 58 (see FIG. 7*c*).

Figure 8:
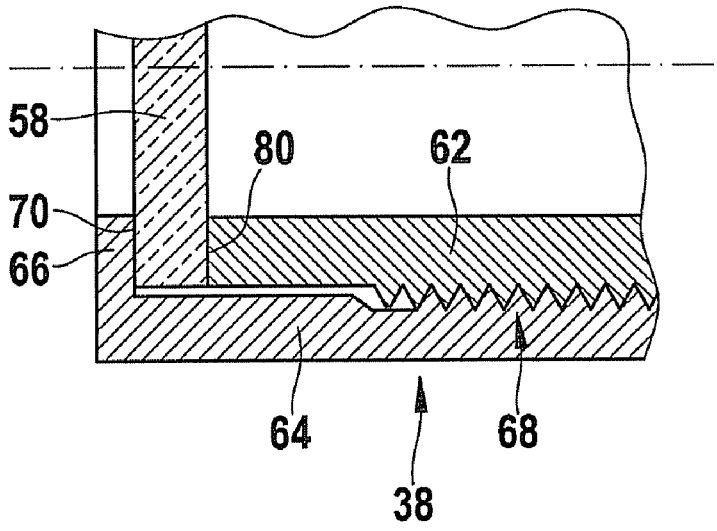

Alternatively, as illustrated in FIG. 8, combustion chamber window 58 may be clamped between projection 66 and inner shell 62 with the aid of thread 68, thus creating two sealing surfaces, namely, first sealing surface 70 and a second sealing surface 78. This exemplary embodiment is illustrated in FIG. 8. Here as well, a thin coating composed of a ductile material such as copper may be provided on sealing surfaces 78 and 70. As an alternative to bracing by use of a thread, it is possible to brace inner shell 62, outer shell 64, and combustion chamber window 58 before the joining procedure, and to join same in this braced state. A non-detachable pretensioned connection may be established in this manner.

What is claimed is:

1. A laser ignition device for an internal combustion engine, comprising:

a laser-active solid;

a combustion chamber window; and a housing in which the laser-active solid is situated;

wherein the housing and the combustion chamber window are pressed together in a sealing manner, wherein the housing and the combustion chamber window are indirectly integrally connected to one another using one of a diaphragm or a spacer ring.

2. A laser ignition device for an internal combustion engine, comprising: a laser-active solid; a combustion chamber window; and a housing in which the laser-active solid is situated; wherein the housing and the combustion chamber window are at least indirectly integrally connected to one another, wherein the housing and the combustion chamber window are indirectly integrally connected to one another using one of a diaphragm or a spacer ring.

3. The laser ignition device as recited in claim 2, wherein the housing includes an inner shell and an outer shell.

4. The laser ignition device as recited in claim 3, wherein the diaphragm is integrally connected to the outer shell and the combustion chamber window.

5. The laser ignition device as recited in claim 3, wherein the diaphragm is integrally connected to the inner shell and the combustion chamber window.

6. The laser ignition device as recited in claim 3, wherein at least one of the inner shell, the diaphragm, and the spacer ring are made of a material whose coefficient of thermal expansion generally corresponds to a coefficient of thermal expansion of the combustion chamber window.

7. The laser ignition device as recited in claim 6, wherein the material is Pernifer 2198 MS manufactured by Thyssen VDM.

8. The laser ignition device as recited in claim 3, wherein at least one of the inner shell, the diaphragm, and the spacer ring are made of a ductile material.

9. The laser ignition device as recited in claim 8, wherein the ductile material is one of nickel (Ni) or copper (Cu).

10. The laser ignition device as recited in claim 3, wherein the outer shell is made of a heat-resistant material.

11. The laser ignition device as recited in claim 10, wherein the heat-resistant material is type 1.4913 steel.

12. The laser ignition device as recited in claim 2, wherein the housing, the diaphragm, the spacer ring, and the combustion chamber window are joined together by one of hard soldering, soft soldering, welding, gluing, or vitrification.

13. The laser ignition device as recited in claim 2, wherein a joint between the housing and the combustion chamber window is situated on a side of the combustion chamber window facing away from a combustion chamber of the internal combustion engine.

14. The laser ignition device as recited in claim 3, wherein at an end facing the combustion chamber, the outer shell has a projection, and the projection partially covers the combustion chamber window.

15. The laser ignition device as recited in claim 14, wherein at an end facing away from the combustion chamber, the outer shell has an internal thread, and the inner shell has an external thread which cooperates with the internal thread of the outer shell, and the combustion chamber window is clamped between the projection of the outer shell and the inner shell.

16. A laser ignition device for an internal combustion engine, comprising: a laser-active solid; a combustion chamber window; and a housing in which the laser-active solid is situated; wherein the housing and the combustion chamber window are at least indirectly integrally connected to one another, wherein at least one of the housing and the combustion chamber window are coated with a sealing material in a region of a sealing surface.

17. The laser ignition device as recited in claim 16, wherein the sealing material is a ductile and heat-resistant sealing material.

18. The laser ignition device as recited in claim 17, wherein the sealing material is copper (Cu).

19. The laser ignition device as recited in claim 16, wherein the coating of sealing material has a thickness of approximately 5 μm to 100 μm.

20. A laser ignition device for an internal combustion engine, comprising:

a laser-active solid;

a combustion chamber window; and a housing in which the laser-active solid is situated;

wherein the housing and the combustion chamber window are pressed together in a sealing manner, wherein at least one of the housing and the combustion chamber window are coated with a sealing material in a region of a sealing surface.

* * * * *